United States Patent [19]

Zemlicka et al.

[11] Patent Number: 4,734,071

[45] Date of Patent: Mar. 29, 1988

[54] MARINE ENGINE EXHAUST ASSEMBLY

[75] Inventors: Alvin R. Zemlicka, Elkhart Lake; Francis Bertram, Malone; Jay L. Menzel, Oshkosh, all of Wis.

[73] Assignee: Brunswick Corporation, Skokie, Ill.

[21] Appl. No.: 37,646

[22] Filed: Apr. 13, 1987

[51] Int. Cl.[4] ..... B63H 21/32

[52] U.S. Cl. ..... 440/89; 60/310

[58] Field of Search ..... 440/88, 89; 60/310, 60/313, 317

[56] References Cited

U.S. PATENT DOCUMENTS

| | | | |
|---|---|---|---|
| 3,631,671 | 1/1972 | Reynolds | 440/89 |
| 3,759,041 | 9/1973 | North et al. | 60/310 |
| 4,504,238 | 3/1985 | Neisen | 440/89 |
| 4,573,318 | 3/1986 | Entringer et al. | 60/310 |

FOREIGN PATENT DOCUMENTS

| | | | |
|---|---|---|---|
| 2174659 | 11/1986 | United Kingdom | 440/89 |

*Primary Examiner*—Joseph F. Peters, Jr.
*Assistant Examiner*—Stephen P. Avila
*Attorney, Agent, or Firm*—Andrus, Sceales, Starke & Sawall

[57] ABSTRACT

A marine engine exhaust assembly (7) is provided with water flow path control devices which minimize back pressure. Lower intermediate elbow portions (8) and the respective bullhorn upper legs (12) are formed and joined in a manner to provide a continuous common gas-water passage which is axially linear in a fore-to-aft direction. The common gas-water passages are formed to provide a gradual reduction in cross-sectional area from top to bottom. The wall contours of the intermediate elbows gradually merge from circular at the upper end to generally elliptical at the lower end. In addition, the wall contours of the upper bullhorn legs are generally elliptical (FIG. 5) at their upper ends for communicating with the intermediate elbows, and gradually merge into a rectangular shape (FIG. 6) in the area of the bullhorn bends (13), which continues on to adjacent the bullhorn discharge portion. The leading edges of gas-water separator plates (25) are formed with a generally V-shaped downstream curve (28) which provides a slicing edge for the water. A gimbal housing (33) has water-carrying lightening pockets (38) which connect from the bullhorn to drain holes (37) in the housing body. The lightening pockets are short and terminate adjacent their respective drain holes. The inner pocket ends are broadly curved (39) in the direction of the respective drain holes.

11 Claims, 11 Drawing Figures

FIG. 3
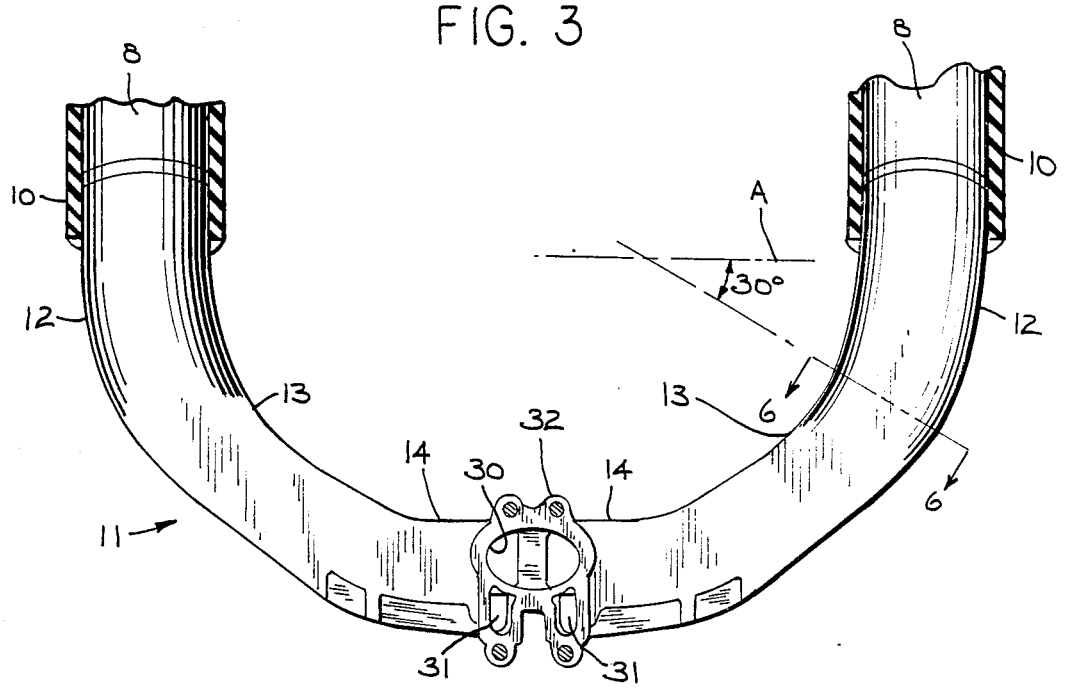
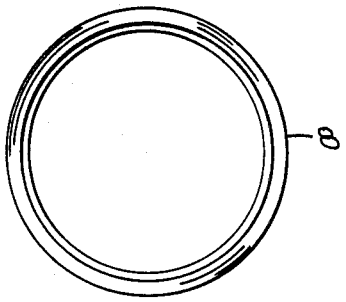
FIG. 4
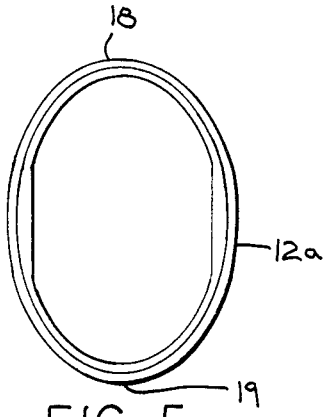
FIG. 5
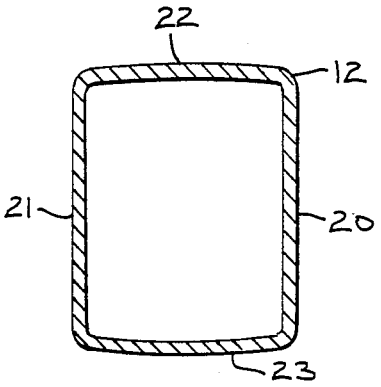
FIG. 6
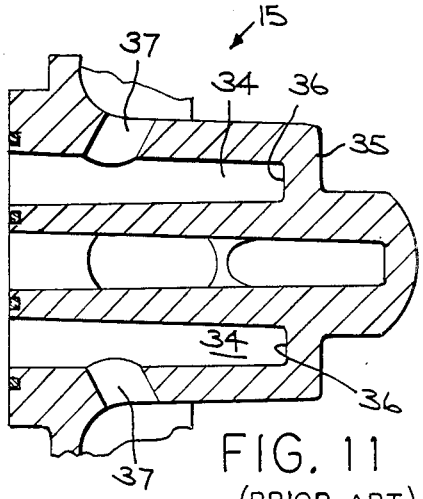
FIG. 11
(PRIOR ART)

MARINE ENGINE EXHAUST ASSEMBLY

U.S. PRIOR ART OF INTEREST

| U.S. Pat. No. | Inventors | Issue Date |
|---|---|---|
| 4,504,238 | Neisen | March 12, 1985 |
| 4,573,318 | Entringer et al | March 4, 1986 |

BACKGROUND AND SUMMARY OF THE INVENTION

This invention relates to a marine engine exhaust assembly, and more particularly to improvements in the external exhaust portions of a stern drive marine engine or the like.

The above-identified U.S. Pat. No. 4,504,238 discloses a typical marine drive including a V-block engine having dual cylinder exhaust elbows which are in turn coupled to an external exhaust system. (Such cylinder exhaust elbows are frequently of the more recent type disclosed in U.S. Pat. No. 4,573,318.) The external system is shown as comprising a pair of upper intermediate elbows which in turn are individually coupled to a lower exhaust pipe, commonly called a "bullhorn". The bullhorn is of generally U-shape and includes a pair of parallel upper pipe legs which merge through bends into a transverse lower pipe portion connected centrally to an exhaust discharge pipe. A baffle or separator plate is shown as being disposed in the lower pipe portion, and takes advantage of centrifugal force to separate cooling water from the exhaust gases traveling therewith. Prior known separator plates have had linear chordal leading edges.

The external exhaust system disclosed in U.S. Pat. No. 4,504,238, as well as other known prior devices of this type, utilizes upper intermediate elbows and bullhorns that are circular in configuration, with each being of generally constant diameter throughout. Furthermore, the exhaust system illustrates one type of "dogleg" therein. That is, a side view of the system would reveal a jogged offset shape, roughly in the form of a Z, formed by each upper elbow in combination with its respective bullhorn leg. Other known doglegs have previously been incorporated entirely in the bullhorn legs themselves.

Although not shown in the aforementioned patents, many marine propulsion exhaust systems include a gimbal attached to the discharge end of the bullhorn, with the separated exhaust and water taking final paths through the gimbal housing in different directions. Due to the relatively massive construction and high weight of such gimbal housings, deep "lightening pockets" have been formed in the housing body to reduce the housing weight. These pockets have been designed to connect with the water discharge passages of the bullhorn, with a final drain holes disposed intermediate the pocket ends for final water discharge out of the housing. The inner ends of the pockets have been generally flat and transverse to the pocket axes.

Engine exhaust back pressure, as measured for example with a manometer in the engine manifold, has always been of concern in the design of marine engines and their exhaust systems. It has been determined that an increase of one psi in back pressure readings results in a decrease in engine horsepower of about 1.5%, which is considered significant to the overall engine performance. Thus, any change in engine and exhaust system construction must be made with the effect on back pressure kept in mind.

Engine exhaust back pressure is greatly influenced by the amount of cooling water induced into the exhaust system, and by how effectively this water is separated from the exhaust gases and ultimately removed from the system. The separators shown in the aforementioned U.S. Pat. No. 4,504,238 are for the purpose of separating the cooling water from the exhaust gases, but it has been noted that at least some water still may flow up and over the tops of the separators into the exhaust gas passages. The presence of this water in the wrong passage is undesirable.

It is an object of the present invention to reduce marine engine exhaust back pressure even further than has been possible heretofore, while maintaining manufacturing efficiencies and costs within acceptable limits.

Broadly in accordance with the various aspects of the invention, a marine engine exhaust assembly is provided with water flow path control means which minimize back pressure. The control means incorporates a plurality of unique "fine tuning" improvements which accumulate to provide what has been found to be a substantial back pressure reduction.

More specifically, a marine engine external exhaust assembly is provided, which is adapted to connect to a pair of engine exhaust elbows which discharge cooling water and exhaust gases thereinto. The assembly includes a pair of intermediate elbows which in turn connect to the upper legs of a bullhorn, with the legs merging through bends into a transverse lower pipe portion. A gas-water shelf-like separator plate is disposed adjacent the bullhorn bends to form individual passages leading to the bullhorn discharge intermediate the ends of the lower pipe section. A gimbal housing is attached to the bullhorn discharge portion.

In accordance with one of the aspects of the invention, the intermediate elbows and bullhorn legs are jointly formed to eliminate the previously known "doglegs". That is, the lower elbow portions and the respective bullhorn upper legs are formed and joined in a manner to provide a continuous common gas-water passage which is axially linear in a fore-to-aft direction.

In accordance with another aspect of the invention, the common gas-water passages are formed to provide a gradual diminishing in cross-sectional area from top to bottom. In the embodiment disclosed herein, the wall contours of the intermediate elbows gradually merge from circular at the upper end to generally elliptical at the lower end. In addition, the wall contours of the upper bullhorn legs are generally elliptical at their upper ends for communicating with the intermediate elbows, and gradually merge into a rectangular shape in the area of the bullhorn bends, which continues on to adjacent the bullhorn discharge portion.

In accordance with yet another aspect of the invention, the leading edges of the gas-water separator plates are formed with a generally V-shaped downstream curve which provides a slicing edge for the water, which is believed to thereby reduce turbulence.

Other aspects of the invention relate to the gimbal housing which has water-carrying lightening pockets which connect from the bullhorn to drain holes in the housing body. In this instance, the lightening pockets have been shortened so that they terminate adjacent their respective drain holes. Furthermore, the inner pocket ends are broadly curved in the direction of the respective drain holes.

BRIEF DESCRIPTION OF THE DRAWINGS

The accompanying drawings illustrate the best mode presently contemplated by the inventors for carrying out the invention.

In the drawings:

FIG. 3 is a rear end view of the lower portion of the assembly, with the gimbal housing removed and parts in section, taken from the right side of FIG. 2;

FIG. 4 is a transverse section of the upper portion of an intermediate elbow taken on line 4—4 of FIG. 2;

FIG. 5 is a transverse section of the upper end portion of a bullhorn leg taken on line 5—5 of FIG. 2;

FIG. 6 is a transverse section of an intermediate portion of a bullhorn taken on line 6—6 of FIG. 3;

FIG. 11 is a view similar to FIG. 10 of a known prior art gimbal.

DESCRIPTION OF THE PREFERRED EMBODIMENT

Figure 1:
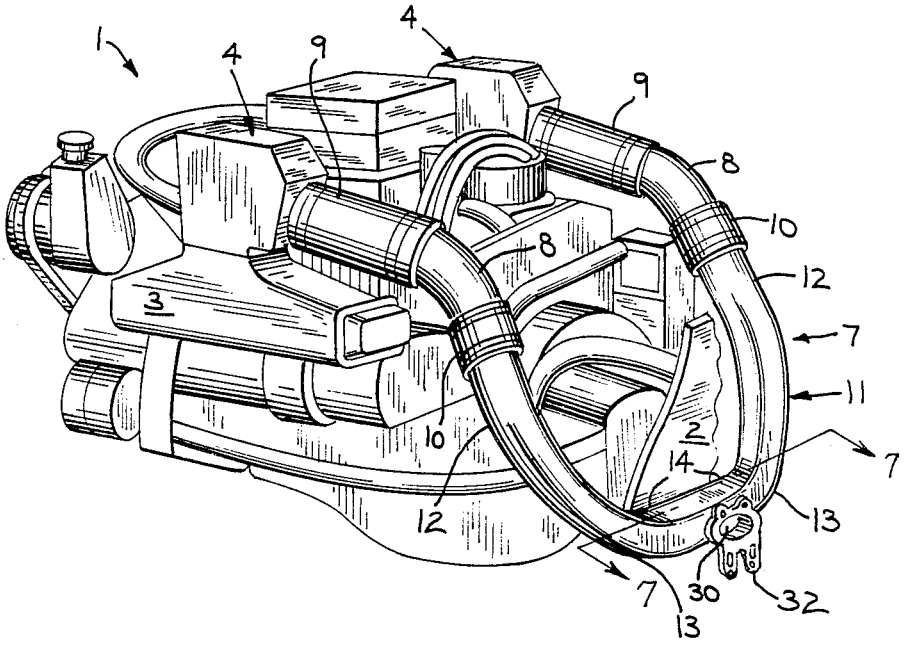
FIG. 1 is a perspective view of a marine internal combustion engine and incorporating the exhaust assembly constructed in accordance with the various aspects of the invention and with the gimbal housing removed.

As illustrated in the drawings, the concepts of the invention are contemplated for use with a stern drive marine engine 1 adapted to be mounted in a boat 2, and which has any suitable construction such as side-by-side banks of water-jacketed cylinders (not shown). Each bank includes a suitable manifold 3 to which is connected an exhaust elbow 4, which may be of the type disclosed in the aforementioned U.S. Pat. No. 4,573,318. Elbow 4 is adapted to receive cooling water and exhaust gases and carry them separately through passages formed by concentric inner and outer tubes 5 and 6 respectively. See FIG. 2. The water and exhaust from each elbow 4 is mixedly discharged into one side of the upstream end of an exhaust assembly 7 which is the subject of the present invention.

Exhaust assembly 7 generally comprises a pair of intermediate tubular elbows 8 connected at their upstream forward ends to exhaust elbows 4, as by suitable couplings 9. The downstream rearward ends of intermediate elbows 8 are joined, as by suitable couplings 10, to a bullhorn 11. Bullhorn 11 is tubular and generally U-shaped and includes a pair of generally parallel upper legs 12 which are coupled in abutting relationship to the terminus end portions of intermediate elbows 8. Legs 12 extend downwardly and in a rearwardly direction and merge through bend portions 13 into transversely extending generally horizontal lower pipes 14. Pipes 14 are in turn joined at their ends to discharge means including a gimbal 15. See FIGS. 2 and 10. The latter is adapted to have a propeller assembly (not shown) pivotally mounted thereto for steering purposes.

As previously mentioned, previous exhaust assemblies included an offset "dogleg" fore-to-aft contour between the engine exhaust discharge and the bottom of the bullhorn. One type of known dogleg is shown in U.S. Pat. No. 4,504,238, which utilizes both the intermediate elbow and bullhorn upper legs, which together form a generally Z-shaped fore-to-aft jog. Another known type of dogleg is shown in phantom at 16 in FIG. 2 of the present drawings, with dogleg 16 being incorporated in the bullhorn's upper leg portions 12.

Figure 2:
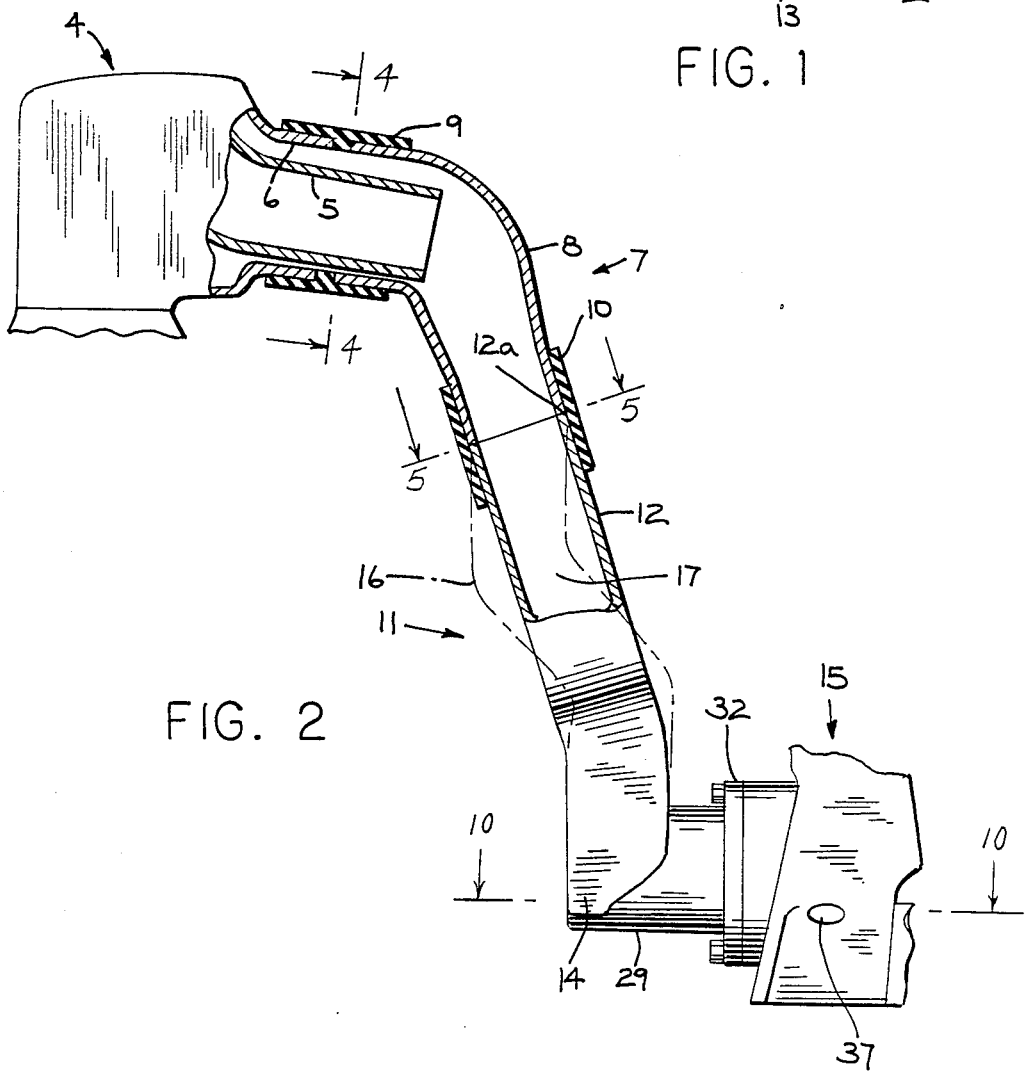
FIG. 2 is an enlarged fragmentary side elevation of portions of the engine and the exhaust assembly, with parts broken away and in section.

One aspect of the present invention contemplates removing the dogleg. Thus, and as best shown in FIG. 2, after intermediate elbow 8 turns downwardly just below coupling 9, it assumes an axially straight direction. Furthermore, upper bullhorn leg portion 12, which abuts elbow 8 at coupling 10, is coaxial with the downward extending portion of elbow 8 and is also axially straight. The result is to provide a continuous gas-water passage 17 which is axially linear in a fore-to-aft direction.

As also previously mentioned, prior known exhaust assemblies have utilized intermediate elbows and bullhorns having circular walls of generally constant diameter.

Another aspect of the present invention contemplates providing for a gradual cross-sectional area reduction from top to bottom of the gas-water assembly passage. For this purpose, and as best seen in FIGS. 2–6, the upstream terminus of intermediate elbow 8 which is coupled to exhaust elbow 4 is circular in shape. See FIG. 4. The wall of elbow 8 merges in a downstream direction into an elliptical shape which corresponds with and generally mirrors the elliptical shape of the upstream terminus 12*a* of a co-coupled bullhorn leg 12, as seen in FIG. 5. The narrow end portions of the ellipse, indicated at 18, 19 are such that they are disposed transversely along the inside and outside wall portions respectively of intermediate elbow 8 and bullhorn 11.

Furthermore, the elliptical upper wall portion of each bullhorn leg gradually merges in a downstream direction into a rectangular shape, as shown in FIG. 6, which is primarily complete adjacent bend 13 and by the time leg 12 is aligned to about 30° from a horizontal transverse plane (A) passing through the upper leg portions. See FIG. 3. The rectangular sectional portion of bullhorn 11, as shown in FIG. 6, provides fore-and-aft positioned walls 20, 21 respectively, which are joined by respective generally flat inside and outside walls 22, 23. Walls 22 and 23 are shown as slightly shorter than walls 20 and 21. It should be noted that outside bullhorn wall 23 forms a continuation of outside wall 19, which in turn is a continuation of the narrow elliptical outside wall of intermediate elbow 8.

The basic rectangular shape shown in FIG. 6 continues on downstream throughout transversely extending horizontal pipes 14.

Figure 7:
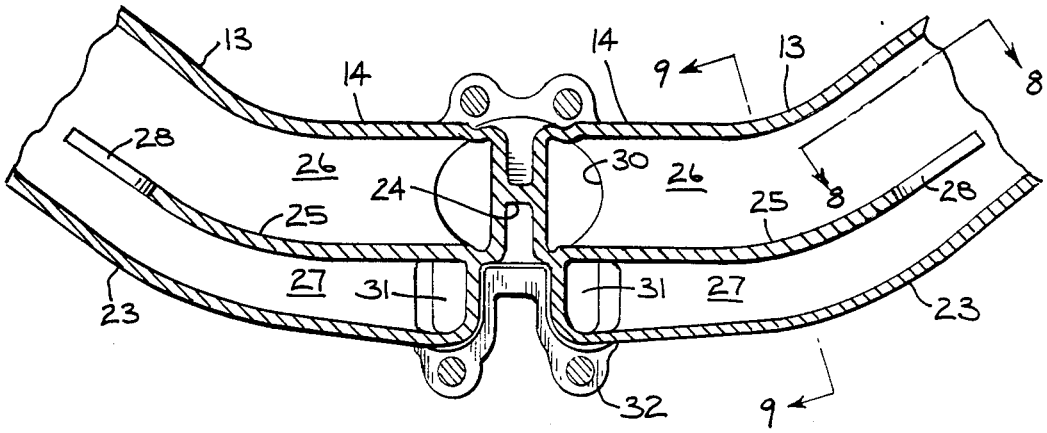
FIG. 7 is a longitudinal section of the lower bullhorn pipe portion taken on line 7—7 of FIG. 1.
Figure 8:
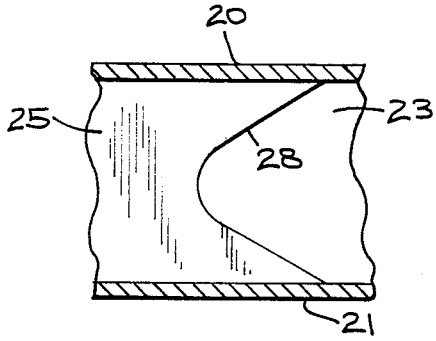
FIG. 8 is a fragmentary view of the leading end portion of a separator plate taken on line 8—8 of FIG. 7.
Figure 9:
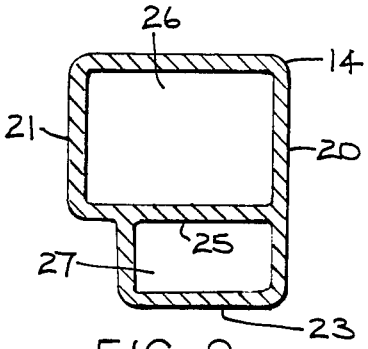
FIG. 9 is a transverse section of the lower bullhorn pipe portion taken on line 9—9 of FIG. 7.

Referring now to FIGS. 7–9, the inner ends of pipes 14 approach each other centrally of the bullhorn with their terminus ends being closed, but joined by a connecting web 24. A pair of separator plates 25 are disposed within the lower passage portion of bullhorn 11, and extend horizontally from adjacent the closed ends of pipes 14 and upstream through the passageways and into the area of bends 13. As shown, each plate 25 may be formed integrally with the passage walls, and separates the main passage, through which comingled cooling water and exhaust are passing, into a pair of vertically disposed upper and lower exhaust and water passages 26, 27 respectively.

As the mixed water and gas move downwardly through bullhorn legs 12, and as bends 13 are encountered, centrifugal force causes the water to be forced outwardly against the outside tube walls, in this instance rectangular walls 23. This is intended to separate the water and exhaust for ultimate separate discharge, but in the past this has not been entirely successful. The rectangular shape of the curved passage adjacent the upstream separator plate end portion, results in the water being forced centrifugally to impinge against flat outer wall 23. The abrupt confining nature of front and rear walls 20 and 21 tends to keep the water to the outside and thus force more of it to enter passage 27 than was the case with the previously used circular passages, wherein the front and rear walls merely were curved extensions of the outside wall and normally on the same radius. Undesirable entry of water into the upper exhaust passage 26 has thus been minimized.

In addition, and referring especially to FIGS. 7 and 8, a further aspect of the invention contemplates forming the leading terminus ends of separator plates 25 with a slicing edge 28 which is believed to reduce turbulence as the water is separated from the exhaust. As shown, edge 28 is concavely curved upstream in a general V-shaped configuration.

Figure 10:
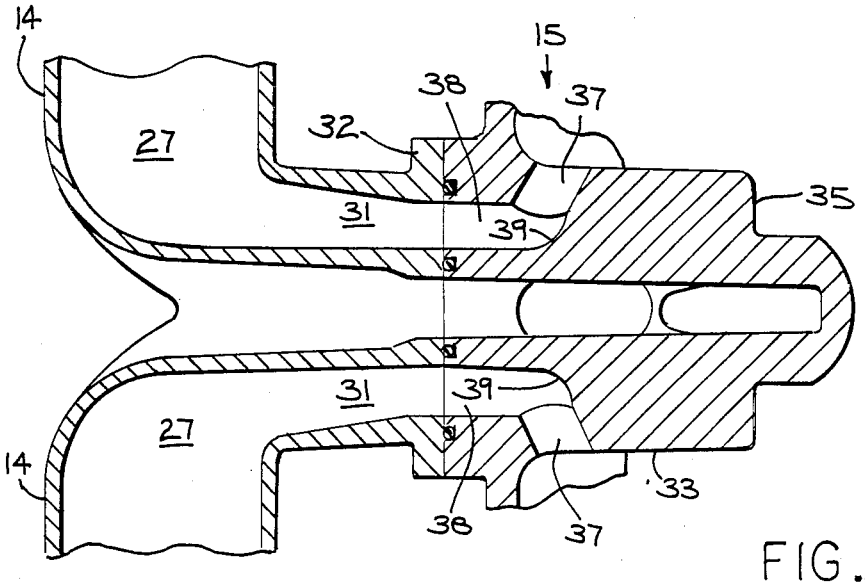
FIG. 10 is a longitudinal section of the bullhorn discharge and gimbal housing with parts broken away and removed, taken on line 10—10 of FIG. 2

Turning now to the separate discharge of water and exhaust from bullhorn 11, and as best shown in FIGS. 2, 3 and 7, the closed terminus end portions of lower pipes 14 are provided with a laterally extending primary duct 29 which includes a relatively large upper exhaust port 30 which communicates with the pair of passages 26 coming from each side of the bullhorn, and also includes a pair of lower water discharge ports 31 which communicate with the pair of water passages 27. A mounting plate 32 is secured to the end of duct 29 in any suitable manner. Referring to FIGS. 2 and 10, gimbal 15 is adapted to be secured to duct 29, as via mounting plate 32.

Because of the basic necessity of disposing the propeller assembly and its associated gimbal centrally along the boat axis, as well as the desirability of centralizing the exhaust-water discharge, it has been found desirable to use the gimbal not only for steering purposes, but also as a means for receiving and discharging the separate water and exhaust from bullhorn 11. For this purpose, gimbal 15 includes a structurally massive housing 33. Housing 33 is provided with means (not shown) for conducting exhaust gases from bullhorn 11. For purposes of the present invention, housing 33 further includes means to receive the separated cooling water from bullhorn 11 and to ultimately discharge the water laterally to the outside.

As shown in FIG. 11, previously known gimbal housings were provided with a pair of elongated "lightening pockets" 34 which were drilled or otherwise formed in the forward housing end and extended longitudinally and horizontally rearwardly almost to the rear housing wall 35, without breaking through, where they terminated in a flat end 36. Pockets 34 were originally designed primarily to reduce the weight of and thus lighten the necessarily massive housing. However, they were also used as a means to receive and conduct water for discharge. This was accomplished by positioning pockets 34 so that the outer end thereof communicated with duct water discharge ports 31. Furthermore, a pair of small generally lateral drain holes 37 were formed in the body side walls of gimbal housing 33, with the holes being positioned intermediate and generally centrally of the housing ends, to maintain the integrity of the housing and for other purposes.

In accordance with another aspect of the invention, and furthermore to reduce possible turbulence and eddy currents in the flowing water which were believed to have occurred within the prior lightening pockets 34, the pockets have been reformed. As shown in FIG. 10, the pockets 38 constructed in accordance with the present invention are shallow and terminate closely adjacent and in communicating relationship with drain holes 37 generally midway between the front and rear housing ends. This positional relationship has been found to provide optimum results in positively affecting engine performance. While the weight advantage has thereby been lessened, the water flow characteristics have been improved.

In addition, the inner ends of pockets 38 are broadly curved, as at 39, in the direction of drain holes 37, to provide a smoother transition of water flow direction; that is, from longitudinal in pockets 38 to lateral in drain holes 37.

Observations of the results obtained in utilizing one or more of the various aspects of the invention have indicated that each aspect serves to reduce measured exhaust back pressure at the engine manifold. Furthermore, when a plurality or all of the aspects are utilized in combination, a dramatic improvement in back pressure, and thus engine horsepower, occurs.

Various modes of carrying out the invention are contemplated as being within the scope of the following claims particularly pointing out and distinctly claiming the subject matter which is regarded as to the invention.

We claim:

1. A marine engine exhaust assembly (7) adapted for connection to the dual water-exhaust discharge means (4) of a boat-mounted marine internal combustion engine (1), comprising, in combination:

(a) a pair of generally parallel upper intermediate tubular elbows (8) connectable at their forward upper ends to said engine, (b) a tubular bullhorn (11) having a pair of upper legs (12) connected at their forward upper ends to the lower rearward ends of said elbows, the lower portions of said legs merging through bends (13) into transversely extending lower pipes (14) having water-exhaust discharge portions, (c) water-exhaust separator plates (25) disposed in said respective lower pipes and with said plates forming separate water and exhaust passages in said pipes, said separator plates having upstream leading edges (28) disposed adjacent said bends, (d) a gimbal housing (33) connected rearwardly of said bullhorn to said lower pipes and with said housing having front and rear ends and having a pair of elongated water-receiving pockets (38) disposed in communication with the said lower pipe discharge portions, said housing furthermore having drain holes (37) disposed generally intermediate said housing ends and communicating between said pockets and the housing exterior, (e) and water flow path control means associated with said elbows, said bullhorn, said separator plates and said gimbal housing to minimize exhaust back pressure at a connected engine.

2. The marine engine exhaust assembly of claim 1 in which said water flow path control means comprises:

(a) continuous common water-exhaust passages of gradually diminishing cross-sectional area formed by said elbows (8) and their respective connected bullhorn upper legs (12), said last-named passages being axially linear in a forward to rearward direction, (b) said elbows being circularly shaped (FIG. 4) adjacent their respective said upper ends and merging gradually downwardly into a generally elliptical shape at their said lower ends, (c) said bullhorn legs (12) being generally elliptically shaped at their said upper ends for communication with the respective lower elbow ends, said legs merging gradually downwardly into a rectangular shape which extends from adjacent said bends (13) and along said lower pipes, (d) the said leading edges (28) of said separator plates (25) being concavely curved, (e) and said gimbal housing pockets (38) being shallow and terminating at their inner ends adjacent and in communication with said drain holes (37), the said pocket inner ends being broadly curved (39) toward said drain holes.

3. In a marine engine exhaust assembly (7) adapted for connection to the dual water-exhaust discharge means (4) of a boat-mounted marine internal combustion engine (1), the combination comprising:

(a) a pair of generally parallel upper intermediate tubular elbows (8) connectable at their forward upper ends to said engine, (b) a tubular bullhorn (11) having a pair of upper legs (12) connected at their forward upper ends to the lower rearward ends of said elbows, the lower portions of said legs merging through bends (13) into transversely extending lower pipes (14) having water-exhaust discharge portions, (c) and continous common water-exhaust passages of gradually diminishing cross-sectional area formed by said elbows (8) and their respective connected bullhorn upper legs (12), said last-named passages being axially linear in a forward to rearward direction, (d) the construction being such to provide water flow path control means contributing to minimizing exhaust back pressure at a connected engine.

4. In a marine engine exhaust assembly (7) adapted for connection to the dual water-exhaust discharge means (4) of a boat-mounted marine internal combustion engine (1), the combination comprising:

(a) a pair of generally parallel upper intermediate tubular elbows (8) connectable at their forward upper ends to said engine, (b) and a tubular bullhorn (11) having a pair of upper legs (12) connected at their forward upper ends to the lower rearward ends of said elbows, the lower portions of said legs merging through bends (13) into transversely extending lower pipes (14) having water-exhaust discharge portions, (c) said elbows being circularly shaped (FIG. 4) adjacent their respective said upper ends and merging gradually downwardly into a generally elliptical shape at their said lower ends, (d) the construction being such to provide water flow path control means contributing to minimizing exhaust back pressure at a connected engine.

5. In a marine engine exhaust assembly (7) adapted for connection to the dual water-exhaust discharge means (4) of a boat-mounted marine internal combustion engine (1), the combination comprising:

(a) a pair of generally parallel upper intermediate tubular elbows (8) connectable at their forward upper ends to said engine, (b) and a tubular bullhorn (11) having a pair of upper legs (12) connected at their forward upper ends to the lower rearward ends of said elbows, the lower portions of said legs merging through bends (13) into transversely extending lower pipes (14) having water-exhaust discharge portions, (c) said bullhorn legs (12) being generally elliptically shaped (FIG. 5) at their said upper ends for communication with the respective lower elbow ends, said legs merging gradually downwardly into a rectangular shape which extends from adjacent said bends (13) and along said lower pipes, (d) the construction being such to provide water flow path control means contributing to minimizing exhaust back pressure at a connected engine.

6. In a marine engine exhaust assembly (7) adapted for connection to the dual water-exhaust discharge means (4) of a boat-mounted marine internal combustion engine (1), the combination comprising:

(a) a pair of generally parallel upper intermediate tubular elbows (8) connectable at their forward upper ends to said engine, (b) a tubular bullhorn (11) having a pair of upper legs (12) connected at their forward upper ends to the lower rearward ends of said elbows, the lower portions of said legs merging through bends (13) into transversely extending lower pipes (14) having water-exhaust discharge portions, (c) and water-exhaust separator plates (25) disposed in said respective lower pipes and with said plates forming separate water and exhaust passages in said pipes, said separator plates having upstream leading edges (28) disposed adjacent said bends, (d) the said leading edges (28) of said separator plates (25) being concavely curved, (e) the construction being such to provide water flow path control means contributing to minimizing exhaust back pressure at a connected engine.

7. In a marine engine exhaust assembly (7) adapted for connection to the dual water-exhaust discharge means (4) of a boat-mounted marine internal combustion engine (1), the combination comprising:

(a) a pair of generally parallel upper intermediate tubular elbows (8) connectable at their forward upper ends to said engine, (b) a tubular bullhorn (11) having a pair of upper legs (12) connected at their forward upper ends to the lower rearward ends of said elbows, the lower portions of said legs merging through bends (13) into transversely extending lower pipes (14) having water-exhaust discharge portions, (c) and a gimbal housing (33) connected rearwardly of said bullhorn to said lower pipes and with said housing having front and rear ends and having a pair of elongated water-receiving pockets (38) disposed in communication with the said lower pipe discharge portions, said housing furthermore having drain holes (37) disposed gènerally intermediate said housing ends and communicating between said pockets and the housing exterior, (d) and said gimbal housing pockets (38) being shallow and terminating at their inner ends adjacent and in communication with said drain holes (37), (e) the construction being such to provide water flow path control means contributing to minimizing exhaust back pressure at a connected engine.

8. In a marine engine exhaust assembly (7) adapted for connection to the dual water-exhaust discharge means (4) of a boat-mounted marine internal combustion engine (1), the combination comprising:

(a) a pair of generally parallel upper intermediate tubular elbows (8) connectable at their forward upper ends to said engine, (b) a tubular bullhorn (11) having a pair of upper legs (12) connected at their forward upper ends to the lower rearward ends of said elbows, the lower portions of said legs merging through bends (13) into transversely extending lower pipes (14) having water-exhaust discharge portions, (c) and a gimbal housing (33) connected rearwardly of said bullhorn to said lower pipes and with said housing having front and rear ends and having a pair of elongated water-receiving pockets (38) disposed in communication with the said lower pipe discharge portions, said housing furthermore having drain holes (37) disposed generally intermediate said housing ends and communicating between said pockets and the housing exterior, (d) and said gimbal housing pockets (38) being shallow and terminating at their inner ends adjacent and in communication with said drain holes (37), the said pocket inner ends being broadly curved (39) toward said drain holes, (e) the construction being such to provide water flow path control means contributing to minimizing exhaust back pressure at a connected engine.

9. The marine engine exhaust assembly of claim 2 or 5 in which: the portions of said bullhorn bends (13) which are about 30° from a transverse plane (A) passing through said upper ends of said legs, are rectangular in shape.

10. The marine engine exhaust assembly of claim 2 or 5 in which the rectangularly shaped bullhorn portions adjacent said bends (13) include:

(a) generally flat outside walls (23) against which centrifugally moving water impinges, (b) and generally flat water-confining front and rear walls (20, 21) joined to the respective outside walls to maximize entry of downwardly flowing water from said legs into said water passages.

11. The marine engine exhaust assembly of claim 2 or 6 in which the said leading edges (28) of said separator plates are generally V-shaped to provide a water slicing action.

* * * * *